US006631687B2

(12) United States Patent
Knighton

(10) Patent No.: US 6,631,687 B2
(45) Date of Patent: Oct. 14, 2003

(54) KEYBOARD TRAY APPARATUS AND METHOD THEREFOR

(76) Inventor: William T. Knighton, P.O. Box 1762, Wausau, WI (US) 54402

( * ) Notice: Subject to any disclaimer, the term of this patent is extended or adjusted under 35 U.S.C. 154(b) by 0 days.

(21) Appl. No.: 09/938,190

(22) Filed: Aug. 24, 2001

(65) Prior Publication Data

US 2003/0037711 A1 Feb. 27, 2003

(51) Int. Cl.[7] ..... A47B 11/00
(52) U.S. Cl. ..... 108/138; 108/143; 108/50.01
(58) Field of Search ..... 108/138, 143, 108/50.01; 248/918, 220.21, 223.31, 240, 241, 243, 244

(56) References Cited

U.S. PATENT DOCUMENTS 5,342,006 A * 8/1994 Tice
5,895,020 A * 4/1999 Danzyger et al.
6,079,676 A * 6/2000 Hackett et al.
6,148,739 A * 11/2000 Martin
6,279,859 B2 * 8/2001 West et al.
6,296,215 B1 * 10/2001 McCoy et al.
6,382,580 B1 * 5/2002 Wisniewski
6,390,432 B1 * 5/2002 VanderHeide et al.
6,419,197 B2 * 7/2002 Kochanski et al.
6,431,512 B1 * 8/2002 Fox et al.
6,488,248 B1 * 12/2002 Watt et al.

FOREIGN PATENT DOCUMENTS

EP 443656 A2 * 8/1999

* cited by examiner

*Primary Examiner*—Jose V. Chen
(74) *Attorney, Agent, or Firm*—Jeffrey Weiss; Harry M. Weiss; Weiss, Moy & Harris, P.C.

(57) ABSTRACT

A keyboard tray apparatus comprising an articulating arm coupled to a table at one end and a keyboard tray at the other. The keyboard tray apparatus provides: (a) a hook and slot system for removably coupling the keyboard tray to an articulating arm with ease; (b) a reversible mouse pad capable of being removably coupled with a spring-biased ball detent to either side of a keyboard tray; and (c) a keyboard tray having a forward two-sleeve set and a rear two-sleeve set and capable of mating with a mouse pad in a forward position or in a rear position.

10 Claims, 3 Drawing Sheets

KEYBOARD TRAY APPARATUS AND METHOD THEREFOR

FIELD OF THE INVENTION

This invention relates generally to keyboard trays and, more specifically, to a keyboard tray apparatus which provides easier attachment and adjustability.

BACKGROUND OF THE INVENTION

With the expansive growth in the field of personal computers, a similar growth in the field of computer accessories has occurred. As the use of computers has increased, so too have the incidents of office workers suffering from fatigue, numbness or tingling in the arms, hands and wrists, carpal tunnel syndrome and other maladies. To combat or prevent these problems, it is necessary for the computer user to maintain the proper posture and hand position when using the keyboard of a computer. Many keyboard accessories accomplish this by providing a keyboard tray slidably coupled to a desk or table. This design is problematic, however, since different computer users have varying arm lengths and body heights which require the keyboard tray to be positioned at varying heights.

To address this problem, some keyboard trays are coupled to an articulating arm which allows for the keyboard tray to be raised or lowered depending upon the needs of the user. Typically, the keyboard tray will be coupled to the articulating arm by an installer. Installation of prior art keyboard trays to prior art articulating arms requires the use of tools and hardware and can be a time-consuming process. Moreover, the removal of the keyboard tray can be necessary when the keyboard tray is in need of repair or replacement, or when one keyboard tray is shared between multiple desks, each having an articulating arm. Where such removal is necessary, it will again involve the same time-consuming process as during installation.

Additionally, some keyboard trays are coupled to a mouse pad to allow the user to engage the use of a mouse on the same plane as the keyboard. However, it is often the case that the mouse pad is fixedly coupled to either the left side of the keyboard (for left-handed users) or the right-side of the keyboard (for right-handed users). If an installer has a right-side mouse, for example, and needs to install a tray/mouse pad combination for a left-handed user, the installer cannot use the right-side mouse/tray combination—or vice-versa. It is also sometimes necessary for the mouse pad to be in a forward position (close to the user) or in a rear position (away from the user) depending on the needs and preferences of the computer user as well as the shape of the desk or workstation.

Moreover, prior art articulating arms couple to the center of the keyboard tray. However, once the mouse pad is attached, the articulating arm is not centered on the tray/pad combination. This can result in a phenomenon known as "mouse bounce," where use of the mouse causes side-to-side wobbling of the tray.

A need therefore existed for a keyboard tray capable of being removably coupled with relative ease to an articulating arm. A need further existed for a reversible mouse pad capable of being removably coupled in a tool-free manner to either side of a keyboard tray, in either a forward position or a rear position. Still further, a need existed for a tray adapted to be coupled with the arm closer to the mouse pad, so as to reduce or eliminate "mouse bounce." The present invention satisfies these needs and provides other, related advantages.

SUMMARY OF THE INVENTION

An object of the present invention is to provide a keyboard tray capable of being removably coupled with relative ease to an articulating arm.

It is a further object of the present invention to provide a keyboard tray having a reversible mouse pad capable of being removably coupled in a tool-free manner to either side of a keyboard tray.

It is yet a further object of the present invention to provide a keyboard tray having a mouse pad capable of being coupled to either a forward position or a rear position along the side of a keyboard tray.

It is a further object of the present invention to provide a keyboard tray adapted to be coupled to an articulating arm at a point other than the center of the tray, so as to reduce or eliminate "mouse bounce."

BRIEF DESCRIPTION OF THE PREFERRED EMBODIMENTS

In accordance with one embodiment of the present invention, a keyboard tray apparatus is disclosed, comprising, in combination, an articulating arm having a table coupling end and a keyboard tray coupling end, the table coupling end is dimensioned to be coupled to a table, the keyboard tray coupling end comprises a plurality of hooks positioned on opposing sides of the keyboard tray coupling end and dimensioned to couple to a keyboard tray, and a keyboard tray having a top surface and a bottom surface and a first side and a second side, a center portion of the bottom surface defines a plurality of slots dimensioned to mate with the plurality of hooks of the keyboard tray coupling end to secure the keyboard tray to the articulating arm.

In accordance with another embodiment of the present invention, a keyboard tray apparatus is disclosed, comprising, in combination, an articulating arm having a table coupling end and a keyboard tray coupling end, the table coupling end is dimensioned to be coupled to a table, the keyboard tray coupling end is dimensioned to be coupled to a keyboard tray, a keyboard tray having a top surface and a bottom surface and a first side and a second side, the keyboard tray is dimensioned to be coupled to the keyboard tray coupling end of the articulating arm, and a reversible mouse pad having a top surface and a bottom surface and a first side and a second side, the first side comprises at least two arms dimensioned to mate with at least two corresponding sleeves in the first side of the keyboard tray, the at least two arms of the first side of the mouse pad are dimensioned to mate with at least two corresponding sleeves in the second side of the keyboard tray when the mouse pad is reversed so that the bottom surface is facing up and the top surface is facing down.

In accordance with yet another embodiment of the present invention, a keyboard tray apparatus is disclosed, comprising, in combination, an articulating arm having a table coupling end and a keyboard tray coupling end, the table coupling end is dimensioned to be coupled to a table, the keyboard tray coupling end is dimensioned to be coupled to a keyboard tray, a keyboard tray having a top surface and a bottom surface and a first side and a second side, the keyboard tray is dimensioned to be coupled to the keyboard tray coupling end of the articulating arm, the first side and the second side of the keyboard tray each define a forward two-sleeve set and a rear two-sleeve set, the forward two-sleeve set is dimensioned to receive a mouse pad in a forward position and the rear two-sleeve set is dimensioned to receive a mouse pad in a rear position.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
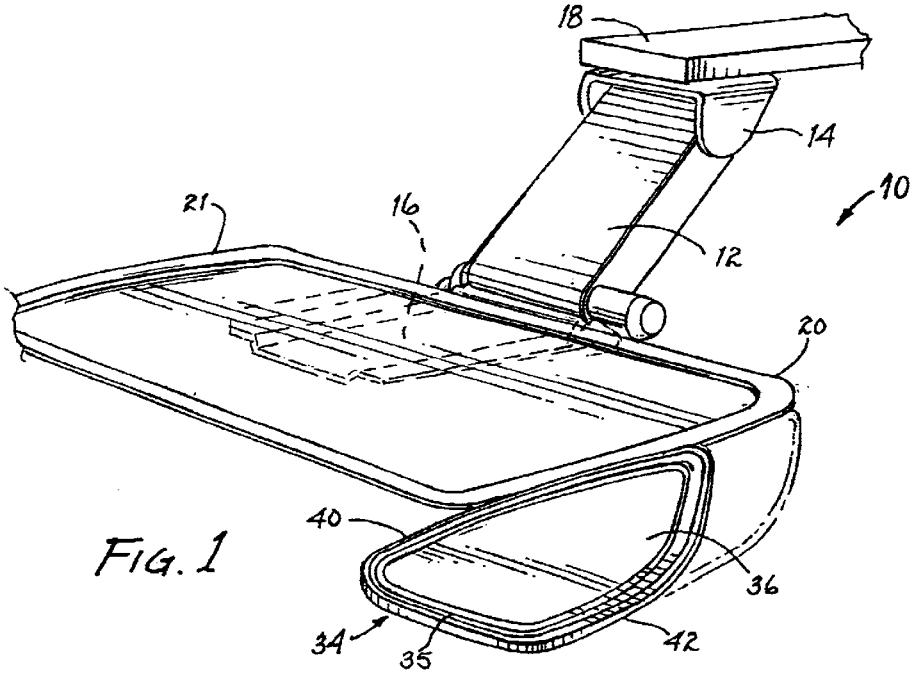
FIG. 1 is a perspective view of the keyboard tray apparatus of the present invention, showing the reversible mouse pad coupled to the first side of the keyboard tray in a forward position.

Referring to FIGS. 1, 2, 5, 7A and 7B, reference number 10 refers generally to one embodiment of the keyboard tray apparatus of the present invention. In this embodiment, the keyboard tray apparatus 10 comprises an articulating arm 12 having a table coupling end 14 and a keyboard tray coupling end 16. The table coupling end 14 is dimensioned to be coupled to a table 18 or other surface. The keyboard tray coupling end 16 of the articulating arm 12 is dimensioned to be coupled to a keyboard tray 20.

Coupling of the keyboard tray coupling end 16 to the keyboard tray 20 is accomplished, in part, by a plurality of L-shaped hooks 22 (shown in FIGS. 5 and 6) positioned on opposing sides of the keyboard tray coupling end 16 and projecting therefrom so that one leg of the L-shape projects at a substantially right angle from the tray coupling end 16 and so that the second leg of the L-shape projects at a substantially right angle from the first leg so as to be substantially parallel to the surface of the tray coupling end 16. The hooks 22 are dimensioned to mate with a corresponding plurality of slots 24 located in a center portion of the bottom surface of the keyboard tray 20, with the second leg of each L-shaped hook 22 passing through a corresponding slot 24, and with the tray 20 then being moved rearward until the first leg of each L-shaped hook 22 contacts the forward end of the corresponding slot 24. In this configuration, a portion of the second leg of each L-shaped hook 22 has now passed beyond the forward end of the corresponding slot 24, preventing the keyboard tray 20 from being lifted off of the tray coupling end 16.

In the preferred embodiment, a first side of the keyboard tray coupling end 16 comprises three hooks 22 dimensioned to mate with three corresponding slots 24 on the bottom surface of the keyboard tray 20, and a second side of the keyboard tray coupling end 16 also comprises three hooks 22 dimensioned to mate with another three corresponding slots 24 on the bottom surface of the keyboard tray 20. While, in the preferred embodiment, the keyboard tray coupling end 16 of the keyboard tray apparatus 10 comprises three hooks 22 on a first side dimensioned to mate with three corresponding slots 24 on the bottom surface of the keyboard tray 20 and three hooks 22 on a second side of the keyboard tray coupling end dimensioned to mate with three corresponding slots 24 on the bottom surface of the keyboard tray 20, it should be clearly understood that substantial benefit could be derived from an alternative configuration of the keyboard tray apparatus 10 in which the number of hooks 22 and slots 24 deviate, even substantially, from the preferred number in either direction, so long as the easy attachment and detachment of the keyboard tray 20 to the articulating arm 12 is maintained.

Figure 5:
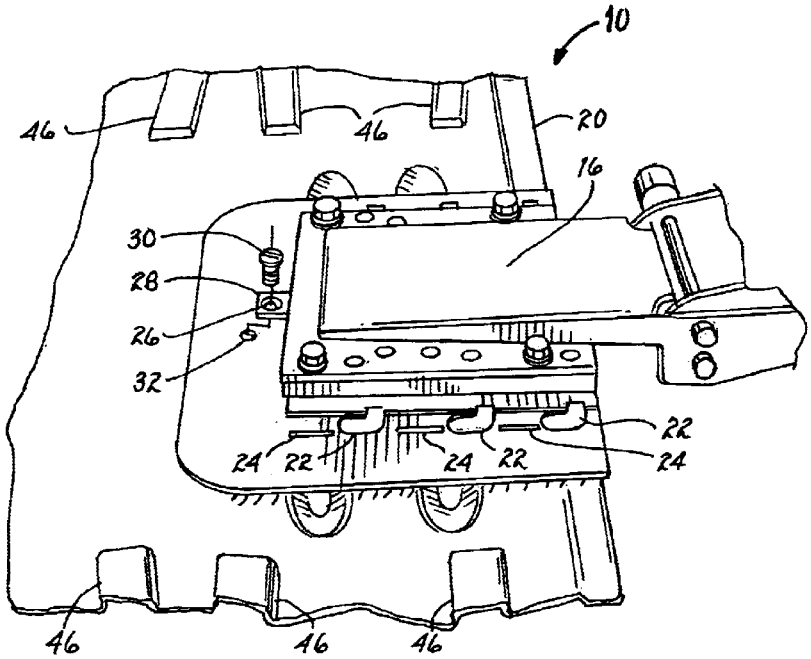
FIG. 5 is a bottom, perspective view of the keyboard tray apparatus of FIG. 1, showing the hooks of the keyboard tray coupling end of the articulating arm and the slots of the keyboard tray.
Figure 6:
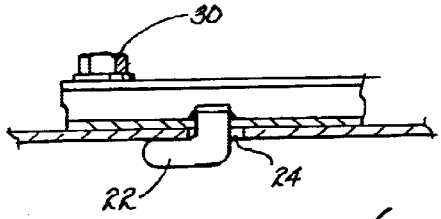
FIG. 6 is a cross-sectional, side view of the keyboard tray apparatus of FIG. 1, showing one of the hooks of the keyboard tray coupling end inserted into one of the slots of the keyboard tray.
Figure 7A:
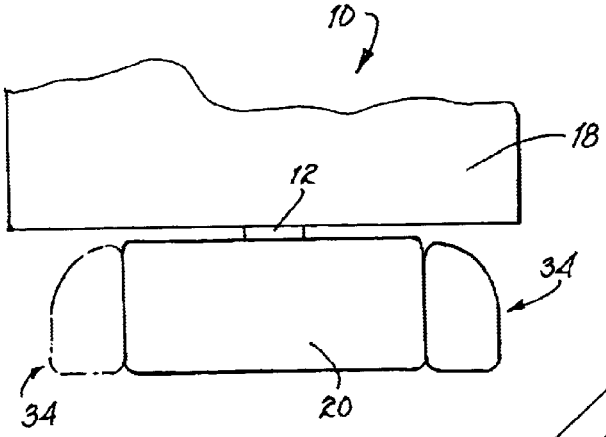
FIG. 7A is a top view of the keyboard tray apparatus of FIG. 1, showing the reversible mouse pad in a rear position.
Figure 7B:
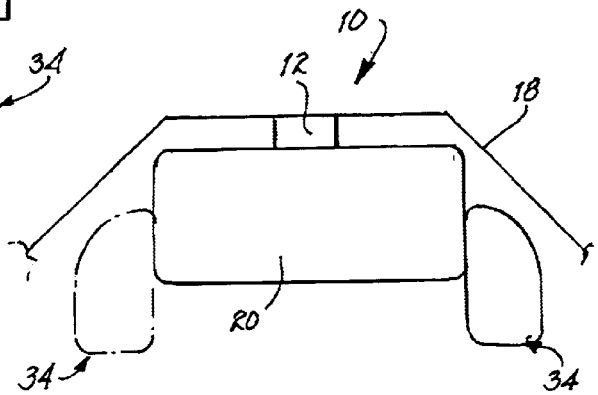
FIG. 7B is a top view of the keyboard tray apparatus of FIG. 1, showing the reversible mouse pad in a forward position.

Referring now to FIG. 5, the keyboard tray coupling end 16 of the articulating arm 12 preferably further comprises a tab 26 defining an aperture 28 therethrough. A thumb screw 30 is dimensioned to be inserted through the aperture 28 in the tab 26 and tightened (preferably by hand) into a corresponding threaded aperture 32 in the bottom surface of the keyboard tray 20 in order to more securely couple the articulating arm 12 to the keyboard tray 20. While, in the preferred embodiment, the keyboard tray coupling end 16 of the articulating arm 12 comprises a tab 26 defining an aperture 28 therethrough and a screw 30 dimensioned to be inserted through the aperture 28 in the tab 26 and into a corresponding threaded aperture 32 in the bottom surface of the keyboard tray 20, it should be clearly understood that substantial benefit could be derived from an alternative configuration of the keyboard tray apparatus 10 in which no tab 26, screw 30, or apertures 28 and 32 are provided.

The structure herein described for coupling the keyboard tray 20 to the keyboard tray coupling end 16 of the articulating arm 12 permits a user to reduce installation time by up to approximately 40% as compared to prior art keyboard tray/tray coupling end combinations.

Figure 2:
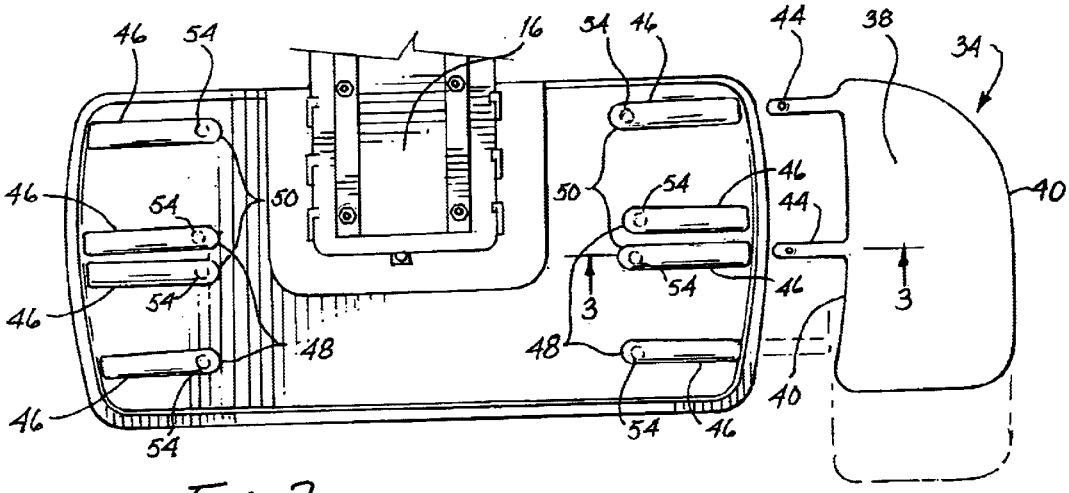
FIG. 2 is a bottom view of the keyboard tray apparatus of FIG. 1, showing the forward two-sleeve set and the rear two-sleeve set of the first side and second side of the keyboard tray.

Referring now to FIG. 2, the keyboard tray apparatus 10 preferably further comprises a reversible mouse pad 34 having a top surface 36 and a bottom surface 38 and a first side 40 and a second side 42. The first side 40 of the reversible mouse pad 34 comprises at least two arms 44 dimensioned to mate with at least two corresponding sleeves 46 in the first side of the keyboard tray 20. The at least two arms 44 are also dimensioned to mate with at least two corresponding sleeves 46 in the second side of the keyboard tray 20 when the mouse pad 34 is reversed so that the bottom surface 38 is facing up and the top surface 36 is facing down. While, in the preferred embodiment, the keyboard tray apparatus 10 comprises a reversible mouse pad 34, it should be clearly understood that substantial benefit could be derived from an alternative configuration of the keyboard tray apparatus 10 which has a fixed mouse pad or no mouse pad at all.

For durability and strength, it is preferred that the keyboard tray 20 and mouse pad 34 be constructed from steel. It is further preferred that the keyboard tray have a molded, raised edge 21 around a perimeter thereof, to prevent the keyboard (not shown) from sliding off during use. Similarly, the mouse pad 34 should also have a molded, raised edge 35 around, to coral the mouse (not shown).

In the preferred embodiment, the first side 40 of the reversible mouse pad 34 comprises two arms 44 and the first side and the second side of the keyboard tray 20 each define a forward two-sleeve set 48 and a rear two-sleeve set 50. The two arms 44 of the mouse pad 34 are dimensioned to mate with the forward two-sleeve set 48 of the first side and the second side of the keyboard tray 20 when the mouse pad 34 is in a forward position (resulting in the configuration shown in FIG. 7B) and the two arms 44 of the mouse pad 34 are dimensioned to mate with the rear two-sleeve set 50 of the first side and the second side of the keyboard tray 20 when the mouse pad 34 is in a rear position (resulting in the configuration shown in FIG. 7A). The preferred placement of the mouse pad 34 will generally depend on work surface shape, with a rear configuration being suitable for a rectangular work surface configured like that shown in FIG. 7A, and a forward configuration being suitable for a forty-five degree angle work surface like that shown in FIG. 7B or a curved work surface. User preference may also play a role in mouse pad 34 placement.

Figure 3:
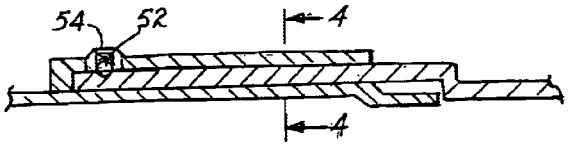
FIG. 3 is a cross-sectional view of an arm of the mouse pad coupled to a sleeve of the keyboard tray of FIG. 1, taken along line 3—3.
Figure 4:
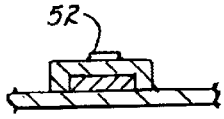
FIG. 4 is a cross-sectional view of the spring-biased ball detent of the arm of the mouse pad of the keyboard tray of FIG. 3, taken along line 4—4.

Referring now to FIGS. 3 and 4, the at least two arms 44 of the keyboard tray apparatus 10 each preferably comprise a spring-biased ball detent 52 located thereon and dimensioned to allow each arm 44 to pass through the sleeve 46 with the ball detent 52 in a retracted position and to allow a portion of the ball detent 52 to project through an aperture 54 in the sleeve 46 when the ball detent 52 is in a projected position—preventing the retraction of the arm 44. The spring-biased ball detent 52 allows for the quick, easy, and secure locking and unlocking of the arms 44 to the sleeves 46—typically in a matter of seconds. (In lieu of the spring-biased ball detent 52, a quick-connect coupler of a different type could be provided that would permit quick, tools-free, coupling and de-coupling of the arms 44 to the sleeves 46.)

Figure 8:
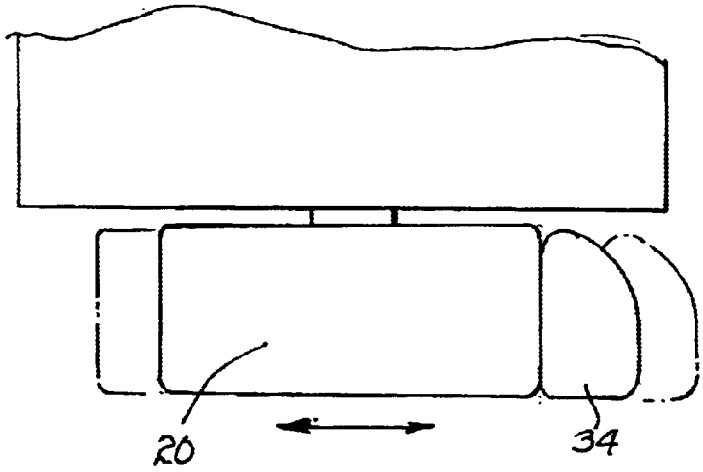
FIG. 8 is a top view of an embodiment of the keyboard tray apparatus of the present invention, illustrating the side-to-side adjustability of the tray vis-a-vis the articulating arm.
Figure 9:
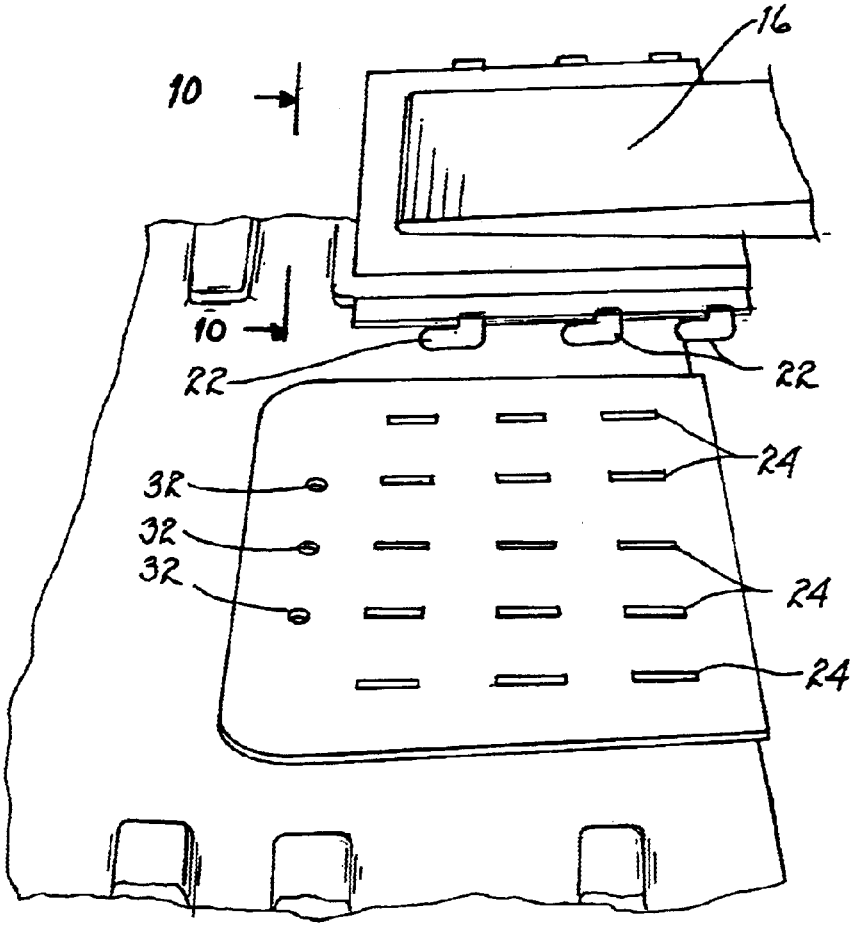
FIG. 9 is a perspective view of the adjustable tray of FIG. 8.

Referring now to FIGS. 8–9, another embodiment of the keyboard tray apparatus 10 is shown. In this embodiment, side to side adjustability in the mounting of the keyboard tray 20 is provided so as to reduce or eliminate mouse bounce. As shown in FIG. 9, multiple rows of slots 24 are positioned along the base of the keyboard tray 20. By selectively positioning the hooks 22 in the desired set of slots 24, the user can position the keyboard tray 20 so that it is centered on the articulating arm 12 (as in FIG. 5), or so that it is more proximate the right side (the preferred position where the mouse pad 34 is located on the right side) or so that it is more proximate the left side (the preferred position where the mouse pad 34 is located on the left side. FIG. 8 illustrates the side to side adjustability as seen from the top of the keyboard, with the mouse pad 34 on the right side and the edge of the keyboard tray 20 on the left side shown in broken lines, to show different possible positions.

While the invention has been particularly shown and described with reference to preferred embodiments thereof, it will be understood by those skilled in the art that the foregoing and other changes in form and details may be made therein without departing from the spirit and scope of the invention.

I claim:

1. A keyboard tray apparatus comprising, in combination:

an articulating arm having a table coupling end and a keyboard tray coupling end, said table coupling end is dimensioned to be coupled to a table, said keyboard tray coupling end comprises a plurality of hooks positioned on opposing sides of said keyboard tray coupling end and dimensioned to couple to a keyboard tray; and a keyboard tray having a top surface and a bottom surface and a first side and a second side, a center portion of said bottom surface defines a plurality of slots dimensioned to mate with said plurality of hooks of said keyboard tray coupling end to secure said keyboard tray to said articulating arm; further comprising:

a tab defining an aperture therethrough, said tab is coupled to said keyboard tray coupling end of said articulating arm; and a set screw dimensioned to be inserted through said aperture in said tab and into a corresponding threaded aperture in said bottom surface of said keyboard tray to more securely couple said articulating arm to said keyboard tray.

2. A keyboard tray apparatus comprising, in combination:

an articulating arm having a table coupling end and a keyboard tray coupling end, said table coupling end is dimensioned to be coupled to a table, said keyboard tray coupling end comprises a plurality of hooks positioned on opposing sides of said keyboard tray coupling end and dimensioned to couple to a keyboard tray; and a keyboard tray having a top surface and a bottom surface and a first side and a second side, a center portion of said bottom surface defines a plurality of slots dimensioned to mate with said plurality of hooks of said keyboard tray coupling end to secure said keyboard tray to said articulating arm; further comprising a reversible mouse pad having a top surface and a bottom surface and a first side and a second side, said first side comprises at least two arms dimensioned to mate with at least two corresponding sleeves in said first side of said keyboard tray, said at least two arms of said first side of said mouse pad are dimensioned to mate with at least two corresponding sleeves in said second side of said keyboard tray when said mouse pad is reversed to that said bottom surface is facing up and said top surface is facing down.

3. The keyboard tray apparatus of claim 2 wherein each of said at least two arms of said reversible mouse pad further comprise a spring-biased ball detent located thereon and dimensioned to allow each arm to pass through said sleeve with said ball detent in a retracted position and to allow a portion of said ball detent to project through an aperture in said sleeve when said ball detent is in a projected position.

4. The keyboard tray apparatus of claim 2 wherein said first side of said reversible mouse pad comprises two arms and said first side and said second side of said keyboard tray each define a forward two-sleeve set and a rear two-sleeve set, said two arms of said mouse pad are dimensioned to mate with said forward two-sleeve set of said first side and said second side of said keyboard tray when said mouse pad is in a forward position and said two arms of said mouse pad are dimensioned to mate with said rear two-sleeve set of said first side and said second side of said keyboard tray when said mouse pad is in a rear position.

5. A keyboard tray apparatus comprising, in combination:

an articulating arm having a table coupling end and a keyboard tray coupling end, said table coupling end is dimensioned to be coupled to a table, said keyboard tray coupling end is dimensioned to be coupled to a keyboard tray;

a keyboard tray having a top surface and a bottom surface and a first side and a second side, said keyboard tray is dimensioned to be coupled to said keyboard tray coupling end of said articulating arm; and a reversible mouse pad having a top surface and a bottom surface and a first side and a second side, said first side comprises at least two arms dimensioned to mate with at least two corresponding sleeves in said first side of said keyboard tray, said at least two arms of said first side of said mouse pad are dimensioned to mate with at least two corresponding sleeves in said second side of said keyboard tray when said mouse pad is reversed so that said bottom surface is facing up and said top surface is facing down.

6. The keyboard tray apparatus of claim 5 wherein each of said at least two arms of said reversible mouse pad further comprise a spring-biased ball detent located thereon and dimensioned to allow each arm to pass through said sleeve with said ball detent in a retracted position and to allow a portion of said ball detent to project through an aperture in said sleeve when said ball detent is in a projected position.

7. The keyboard tray apparatus of claim 5 wherein said first side of said reversible mouse pad comprises two arms and said first side and said second side of said keyboard tray each define a forward two-sleeve set and a rear two-sleeve set, said two arms of said mouse pad are dimensioned to mate with said forward two-sleeve set of said first side and said second side of said keyboard tray when said mouse pad is in a forward position and said two arms of said mouse pad are dimensioned to mate with said rear two-sleeve set of said first side and said second side of said keyboard tray when said mouse pad is in a rear position.

8. A keyboard tray apparatus comprising, in combination:

an articulating arm having a table coupling end and a keyboard tray coupling end, said table coupling end is dimensioned to be coupled to a table, said keyboard tray coupling end is dimensioned to be coupled to a keyboard tray;

a keyboard tray having a top surface and a bottom surface and a first side and a second side, said keyboard tray is dimensioned to be coupled to said keyboard tray coupling end of said articulating arm, said first side and said second side of said keyboard tray each define a forward two-sleeve set and a rear two-sleeve set, said forward two-sleeve set is dimensioned to receive a mouse pad in a forward position and said rear two-sleeve set is dimensioned to receive a mouse pad in a rear position.

9. The keyboard tray apparatus of claim 8 further comprising a reversible mouse pad having a top surface and a bottom surface and a first side and a second side, said first side comprises at least two arms dimensioned to mate with said forward two-sleeve set of said first side and said second side of said keyboard tray when said mouse pad is in a forward position and said at least two arms of said mouse pad are dimensioned to mate with said rear two-sleeve set of said first side and said second side of said keyboard tray when said mouse pad is in a rear position.

10. The keyboard tray apparatus of claim 9 wherein each of said at least two arms of said reversible mouse pad further comprise a spring-biased ball detent located thereon and dimensioned to allow each arm to pass through said sleeve with said ball detent in a retracted position and to allow a portion of said ball detent to project through an aperture in said sleeve when said ball detent is in a projected position.

* * * * *

UNITED STATES PATENT AND TRADEMARK OFFICE

CERTIFICATE OF CORRECTION

PATENT NO. : 6,631,687 B2
DATED : October 14, 2003
INVENTOR(S) : William W. Knighton It is certified that error appears in the above-identified patent and that said Letters Patent is hereby corrected as shown below:

Title page,
Item [76], Inventors, change "T." to -- W. --

Signed and Sealed this

Twenty-seventh Day of January, 2004

JON W. DUDAS
*Acting Director of the United States Patent and Trademark Office*